United States Patent [19]

Dancy

[11] Patent Number: 4,480,750

[45] Date of Patent: Nov. 6, 1984

[54] BAG CONSTRUCTION

[75] Inventor: H. Gordon Dancy, Middletown, Ohio

[73] Assignee: Sonoco Products Company, Hartsville, S.C.

[21] Appl. No.: 611,250

[22] Filed: May 17, 1984

[51] Int. Cl.[3] ..... B65D 85/62; B65D 30/00

[52] U.S. Cl. ..... 206/554; 206/526; 383/8

[58] Field of Search ..... 206/554, 494, 449, 526; 383/8

[56] References Cited

U.S. PATENT DOCUMENTS

| | | | |
|---|---|---|---|
| 3,352,411 | 11/1967 | Schwartzkopf | 206/493 |
| 3,774,838 | 11/1973 | Christie | 383/8 |
| 3,966,524 | 6/1976 | Lehmacher | 383/8 |
| 4,062,170 | 12/1977 | Orem | 53/390 |
| 4,165,832 | 8/1979 | Kuklies et al. | 383/8 |
| 4,199,122 | 4/1980 | Christie | 248/97 |
| 4,326,664 | 4/1982 | Benoit et al. | 383/8 |
| 4,406,371 | 9/1983 | Membrino | 206/554 |

FOREIGN PATENT DOCUMENTS

| | | | |
|---|---|---|---|
| 2710150 | 9/1978 | Fed. Rep. of Germany | 206/554 |
| 1464148 | 11/1966 | France | 206/554 |
| 2427982 | 2/1980 | France | 206/554 |
| 1131063 | 10/1968 | United Kingdom | 383/8 |

*Primary Examiner*—William T. Dixson, Jr.
*Assistant Examiner*—Brenda J. Ehrhardt
*Attorney, Agent, or Firm*—Dennison, Meserole, Pollack & Scheiner

[57] ABSTRACT

A thermoplastic bag having front and rear walls with smooth upper edges defining an open bag mouth. A pair of laterally spaced integral loop handles extend upward from the bag mouth and include detachable mounting tabs projecting laterally inward from the handles at an intermediate point along the height thereof. The tabs are remote from the bag mouth and, in a bag pack, form the securing area for the bags.

11 Claims, 3 Drawing Figures

BAG CONSTRUCTION

BACKGROUND OF THE INVENTION

1. Field of the Invention

The invention is concerned with thermoplastic bag construction, and more particularly the construction of bags to be supplied in multiple bag packs wherein severable tabs interlock the bags and allow for a separable dispensing of the individual bags. Such bags normally incorporate integral handles and are mounted on a dispensing rack by the tabs which are severed as the individual bags are physically pulled from the rack.

The bags are frequently formed by utilization of flattened tube portions selectively severed from a length of tubing of appropriate material and subsequently heat sealed along the lower and upper edges thereof. An appropriate mouth-defining U-shaped cutout is normally made through the sealed upper edge, the cutout simultaneously defines opposed handles. The known bags have been formed both with and without side gussets.

2. Description of the Prior Art

Typical examples of the known prior art will be seen in the following patents:

U.S. Pat. No. 3,352,411, to Schwarzkopf
U.S. Pat. No. 4,062,170, to Orem
U.S. Pat. No. 4,165,832, to Kuklies et al.
U.S. Pat. No. 4,199,122, to Christie Schwarzkopf illustrates a basic bag construction wherein a partially severed U-shaped flap defines a detachable tab which, upon separation from the bag, forms two handles. The partially severed flap constitutes the means by which the bag is mounted in a pack and on a dispensing rack.

The patent to Kuklies et al discusses the general nature of the known art, as exemplified by the Schwarzkopf patent, and proposes modifications in the handle configuration, the configuration of the bag mouth, and the location of the detachable tab. Basically, Kuklies et al provides a handle and mouth arrangement which includes an enlarged projecting detachable tab fixed centrally along the mouth by a perforated or tear area, the opposed ends of the mouth incorporating downwardly enlarged notches indicated as being for stress relief. Upon removal of the Kuklies bag from the mounting tab, the mouth of the bag retains, along each bag wall, an upwardly projecting flap with a perforation-defined edge and opposed enlarged end notches. The projecting flap and perforation edge, in the high stress area of the bag mouth, form areas of potential weakness.

Both Christie and Orem disclose racks for stacks of handle bags. The bags in Orem include detachable perforated tabs along the mouth-defining upper edges of the bag walls.

SUMMARY OF THE INVENTION

The bag construction in accordance with the present invention incorporates structural improvements which substantially enhance the appearance, strength, structural stability, and ease of use of the bag. The anticipated advantages are achieved through a unique formation and configuration of the bag at the handle and mouth area thereof.

More particularly, the present invention proposes formation of the bag with a continuous and uninterrupted upper or mouth edge which, at the opposite ends thereof, blends into the inner edges of the lateral handles through arcuate corners. The mouth of the proposed bag includes no unsightly flaps as may interfere with the introduction and removal of commodities. Similarly, the bag mouth has no roughened edge portions defined by the severing of a tab therefrom, as may tear when subjected to flexing or distortion during bag loading. Further, elimination of a tear-defined portion along the mouth edge avoids the necessity for enlarged stress-relieving notches which decrease the effective depth of the bag.

The present invention proposes provision of the pack-forming detachable tabs as minor integral extensions formed at a central or intermediate point along the inner edges of the bag handles of a bag remote from the mouth thereof. Positioned in this manner, a multiple-bag pack can be effectively mounted on a dispensing rack through an engagement of both sets of tabs. This in turn produces a stable orientation of the bags with a positive retention and positioning of both handles thereof for easy access to the handles and manipulation of the individual bags for removal from the pack.

DESCRIPTION OF PREFERRED EMBODIMENT

Figure 1:
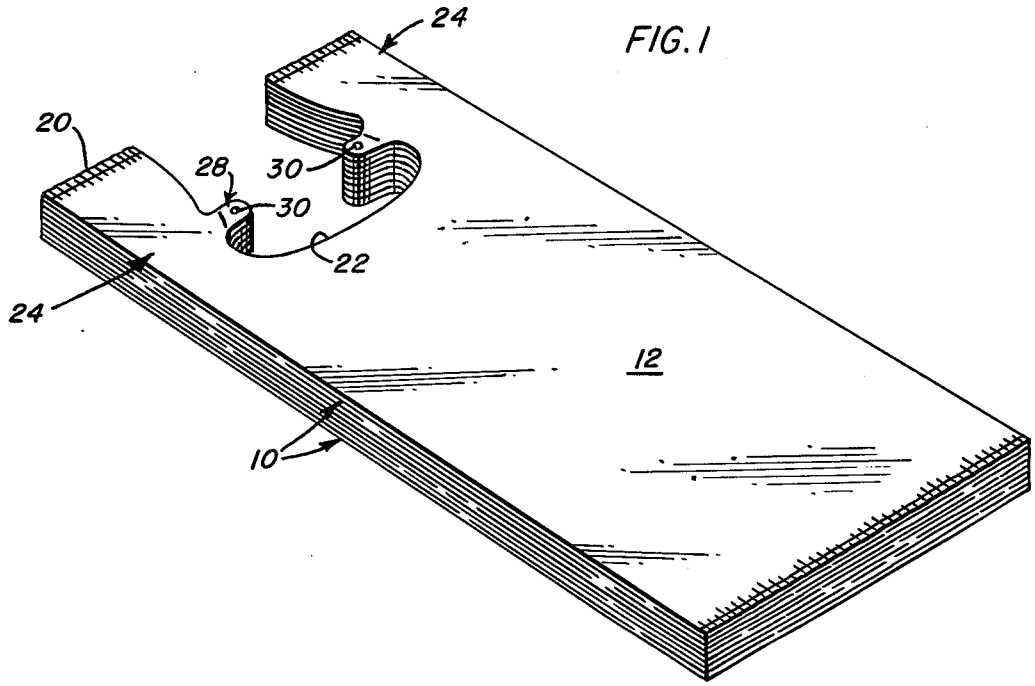
FIG. 1 is a perspective view of a pack of bags formed in accord with the present invention.

Referring now more specifically to the drawings, the bag 10, as illustrated, can conveniently be fabricated from a plastic tube gusseted, flattened and heat sealed at opposed upper and lower ends.

The formed bag includes planar opposed panels respectively designated as front panel 12 and rear panel 14 for purposes of illustration. The side edges of the overlying panels 12 and 14 are interconnected by full length inwardly folded integral gussets 16 which allow for an expansion of the bag in an obvious manner.

Both the upper and lower edges of the panels 12 and 14, as well as the corresponding end edges of the gusset 16, are heat sealed throughout the length thereof as at 18 and 20. The sealed structure is then cut away inwardly and centrally through the heat sealed upper edge 20 to define both a bag mouth 22 and a pair of laterally opposed handles 24. The defined handles 24 will generally taper along the height thereof from narrow lower portions adjacent the mouth 22 of the bag to relatively wider upper end portions at the defined seam 20. In forming the tapered configuration, the opposed inner edges of the handles 24, as will be best appreciated in FIG. 2, diverge downwardly and terminate in stress-relieving arcuate corner portions 26 which join the vertical handle edges with the straight or slightly arcuate bag mouth 22. As will be recognized, the bag mouth 22, inward of the opposed arcuate corners 26, is, in its entirety, at or below the arcuate corners 26. The handles are completed by the provision of integral inwardly directed mounting tabs 28, one provided at an intermediate point along the height of each handle 24 above the corresponding arcuate corners 26 and below the sealed upper edge 20, preferably at generally mid-height. Each detachable tab includes a mounting aperture 30 therethrough and a line of weakness 32, defined by a partial cut, perforations, or the like, slightly outward from the line of the handle edge to define a small residual flap 34 subsequent to detachment of the bag from the tabs 28.

Figure 2:
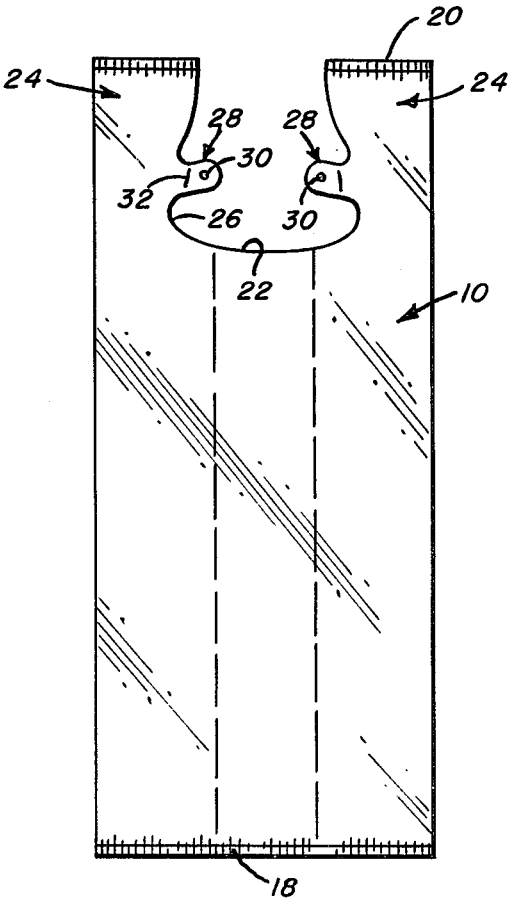
FIG. 2 is a front elevational view of a single bag.
Figure 3:
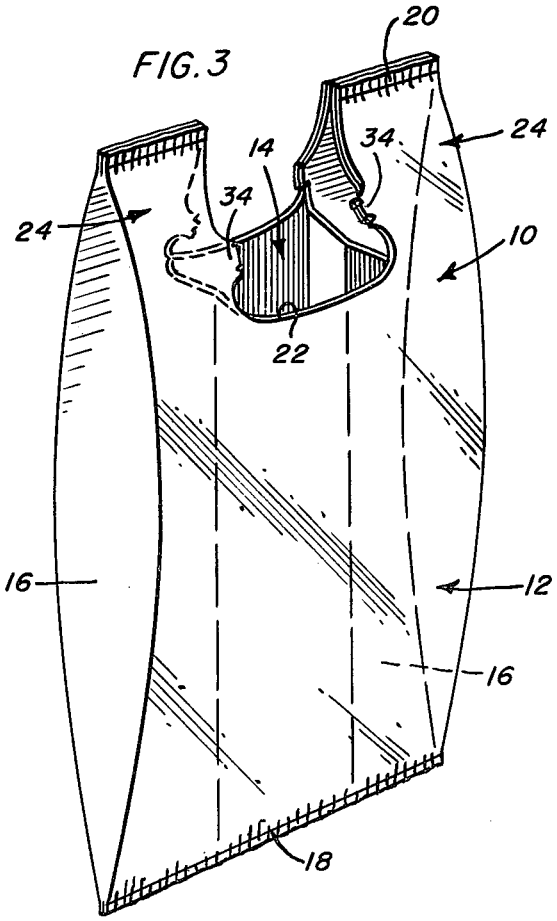
FIG. 3 is a perspective view of a bag removed from the detachable mounting tabs and partially open.

Noting FIGS. 2 and 3 in particular, it will be appreciated that the generally U-shaped cut which defines the handles 24 and the bag mouth 22 extends through the inner folds of the opposed gussets 16, severing the central portions of the gussets above the bag mouth 22 and providing for a loop handle construction with each handle formed of both an inner gusset layer and an outer panel layer. The formed tabs 28 will comprise four layers and, until severed, provide for a positive retention of both the panels and inner gusset layers.

The upper portion cutout configures the front and rear panels 12 and 14 to define front and rear bag walls downward from the formed mouth 22, and upwardly extending handle-forming front and rear handle wall portions which terminate at the sealed upper edge 20 along each formed handle 24. These upwardly extending handle wall portions combine with the underlying separated gusset portions in forming what might be considered reinforced handles directly supportive of the four bag walls defined by the opposed panels and opposed gussets.

The described bag construction will normally be provided in a bag pack, as illustrated in FIG. 1. Such packs are formed preferably by a heat welding of the mounting tabs 28 to each other. This in turn can easily be effected simultaneously with the forming of the mounting apertures 30 through the aligned tabs 28 of a stack of bags 10 by utilizing a heated rod or the like. The rod, while forming the apertures through the thermoplastic material of the bag tabs, will also cause a melting and flowing of the material around the periphery of each aperture, fusing these peripheral areas together.

In use, the bag pack will normally mount over the rear portion of a rack with the bags individually forwardly drawn to detach from the tabs and engage the loop handles over opposed rack projections to maintain the individual bag upright and open. This general environment will be noted in the above referred to patents to Orem and Christie.

It is particularly to be appreciated that the provision of the tabs at an intermediate portion along the height of the inner edges of the opposed handles is significant in providing for mounting tabs at a location which stabilizes and both individually and directly supports the handle portions of the bags for easy and convenient access thereto. This in turn greatly facilitates the hand gripping of the handles and the forward drawing thereof to separate the handles from the mounting tabs and simultaneously open the handles for engagement over the rack projections.

It is also considered of particular significance that the tabs are formed remote from the bag mouth, thereby avoiding any disruption of the bag mouth through either the provision of a tear line therealong or a disruptive projection. As will be appreciated from a viewing of the basic rack constructions of the Orem and Christie patents, applicant, by providing the detachable mounting tabs at generally mid-height along the handle inner edges, insures that the slight remainder flaps which project upon severance from the tabs will be located laterally outward of the main body of the bag and the upwardly opening mouth through which the commodities are to be introduced. Similarly, the tab remainders in applicant's bag construction will have no effect on the structural integrity of the multiple ply handles which, in use, will be inwardly gathered toward each other with only minimal stress specifically along the inner edges of the gathered bag handles.

From the foregoing, it will be appreciated that a distinctive bag construction has been presented wherein specific provision is made to incorporate detachable mounting tabs on rack-mountable bags in a manner whereby the complete integrity of the mouth of the bag is retained, avoiding both mouth or edge weakening tear areas and edge disruptive flaps. Simultaneously, provision is made to locate the tabs in a manner whereby the individual laterally spaced handles are themselves directly supported and retained in a readily and easily accessible position for a direct physical grasping and movement thereof for disengagement from the tabs and a positioning of the individual bags in loading position.

The foregoing is considered illustrative of the principles of the invention. Suitable modifications and variations, as may occur to those skilled in the art, may be made without departing from the spirit or scope of the invention.

I claim:

1. A bag construction comprising front and rear bag walls, a closed bottom, and a top portion, said top portion having a pair of laterally spaced handles, said handles including integral extensions of said front and rear bag walls, said front and rear bag walls, between said handles, defining an open bag mouth, each said handle extending above the bag mouth from a lower handle portion defining the lateral extent of said bag mouth to an upper handle portion defining a hand grip, and detachable tab means integral with each handle intermediate the upper and lower handle portions thereof and remote from said bag mouth.

2. The bag construction of claim 1 wherein said handles include inner edges, said tab means comprises an individual tab integral with each handle inner edge, the tab on each handle being laterally aligned with and spaced from the tab on the other handle.

3. The bag construction of claim 2 wherein each tab includes a severance line thereacross spaced from the corresponding handle inner edge.

4. A handle bag comprising front and rear bag walls, a closed bottom, an open top, handle means integral with said front and rear bag walls and projecting upwardly from the open top of said bag, and detachable tab means integral with said handle means at a point intermediate the height of said handle means and remote from said open top.

5. The handle bag of claim 4 wherein said handle means includes front and rear handle wall portions including integral extensions of the front and rear walls above said open top, said handle wall portions having opposed edges along the height of the handle means, said detachable tab means extending from selected ones of said edges.

6. The handle bag of claim 5 wherein said handle means comprises a pair of laterally spaced handles, said detachable tab means comprising a detachable tab on and projecting from each handle.

7. The handle bag of claim 6 including side gussets interconnecting said front and rear bag walls, and integral extensions of said gussets extending coextensive with the front and rear handle wall portions.

8. The handle bag of claim 7 wherein each tab is multi-layered and defined by laterally directed portions of the handle forming handle wall portions and gusset extensions.

9. A bag pack for selective dispensing of bags, said pack comprising multiple stacked thermoplastic bags, each bag comprising front and rear bag walls defining an open upwardly directed bag mouth, a pair of laterally spaced handles extending upwardly from said front and rear walls and above said open bag mouth, and a detachable tab integral with each handle at an intermediate point along the upward extent thereof and upwardly spaced from the bag mouth.

10. The construction of claim 9 wherein the tabs of the stacked bags align with each other, and means joining each of said tabs to all aligned adjoining tabs.

11. The construction of claim 10 wherein the tabs of each bag project laterally inwardly from the associated handle toward each other.

* * * * *

Adverse Decision In Interference

In Interference No. 101,984, involving Patent No. 4,480,750, H. G. Dancy, BAG CONSTRUCTION, final judgment adverse to the patentee was rednered March 14, 1990, as to claims 1-11.
*[Official Gazette August 28, 1990]*